US010851682B2

(12) United States Patent
Baltrucki

(10) Patent No.: US 10,851,682 B2
(45) Date of Patent: Dec. 1, 2020

(54) ENGINE VALVE ACTUATION SYSTEMS WITH LOST MOTION VALVE TRAIN COMPONENTS, INCLUDING COLLAPSING VALVE BRIDGES WITH LOCKING PINS

(71) Applicant: Jacobs Vehicle Systems, Inc., Bloomfield, CT (US)

(72) Inventor: Justin D. Baltrucki, Canton, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 16/455,248

(22) Filed: Jun. 27, 2019

(65) Prior Publication Data

US 2020/0003085 A1 Jan. 2, 2020

Related U.S. Application Data

(60) Provisional application No. 62/691,947, filed on Jun. 29, 2018.

(51) Int. Cl.

| | |
|---|---|
| ***F01L 1/18*** | (2006.01) |
| ***F01L 1/26*** | (2006.01) |
| ***F01L 13/00*** | (2006.01) |

(52) U.S. Cl.

CPC ..... *F01L 1/267* (2013.01); *F01L 13/0005* (2013.01)

(58) Field of Classification Search

CPC ..... F01L 1/181; F01L 1/267; F01L 13/0005; F01L 2001/467; F01L 2013/001; F01L 2013/105; F01L 2105/00

See application file for complete search history.

(56) References Cited

U.S. PATENT DOCUMENTS

| | | | |
|---|---|---|---|
| 4,592,319 | A | 6/1986 | Meistrick |
| 5,398,648 | A | 3/1995 | Spath et al. |
| 5,709,180 | A | 1/1998 | Spath |
| 5,950,583 | A | 9/1999 | Kraxner et al. |
| 6,196,175 | B1 | 3/2001 | Church |
| 6,513,470 | B1 | 2/2003 | Hendriksma et al. |
| 6,578,535 | B2 | 6/2003 | Spath et al. |

(Continued)

FOREIGN PATENT DOCUMENTS

EP 2975230 A1 1/2016

OTHER PUBLICATIONS

International Search Report and Written Opinion for International Application No. PCT/US2019/039578 dated Oct. 15, 2019, 6 pages.

*Primary Examiner* — Zelalem Eshete
(74) *Attorney, Agent, or Firm* — Moreno IP Law LLC

(57) ABSTRACT

Systems for valve actuation in internal combustion engines provide configurations for collapsing valve train components, particularly collapsing valve bridges. Various configurations for locking a bridge piston to a bridge housing include substantially cylindrical locking pins that may be housed within a substantially cylindrical receptacles defined by a transverse bore in the bridge piston and actuated hydraulically and may include an actuating pin that interacts with the locking pins to synchronize motion and provide positive positioning within an annular recess in the bridge housing to lock or unlock the bridge piston for movement relative to the bridge housing. Various geometries for locking pins and actuating pins provide benefits of manufacturing, ease of assembly, alignment and reduced wear.

15 Claims, 9 Drawing Sheets

(56) References Cited

U.S. PATENT DOCUMENTS

| | | | | |
|---|---|---|---|---|
| 6,752,121 | B2 | 6/2004 | Rayl et al. | |
| 7,673,601 | B2 | 3/2010 | Spath et al. | |
| 8,646,425 | B2 | 2/2014 | Methley et al. | |
| 8,936,006 | B2 | 1/2015 | Groth et al. | |
| 9,790,824 | B2 * | 10/2017 | Baltrucki ..... | F01L 1/18 |
| 2004/0244751 | A1 | 12/2004 | Falkowski et al. | |
| 2006/0272598 | A1 * | 12/2006 | Wakeman ..... | F01L 1/08<br>123/21 |
| 2012/0132162 | A1 | 5/2012 | Yoon et al. | |
| 2013/0098319 | A1 | 4/2013 | Methley | |

* cited by examiner

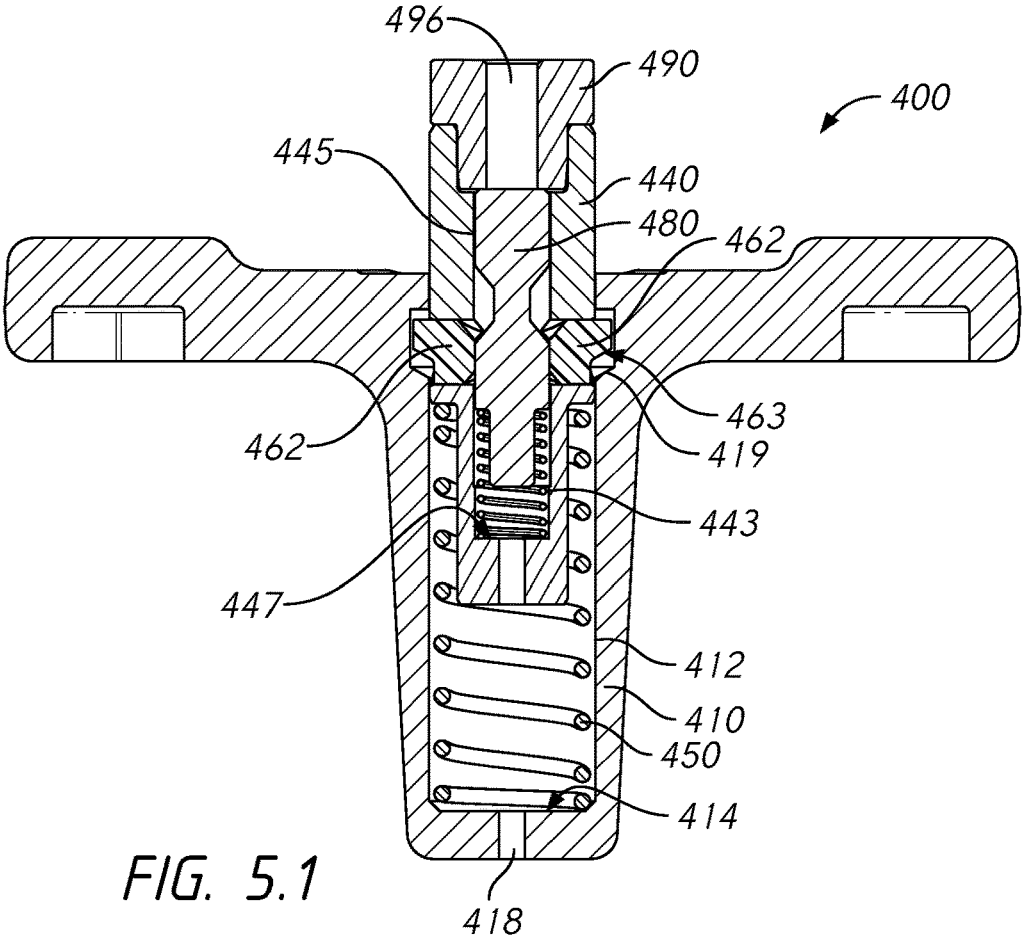
FIG. 5.1
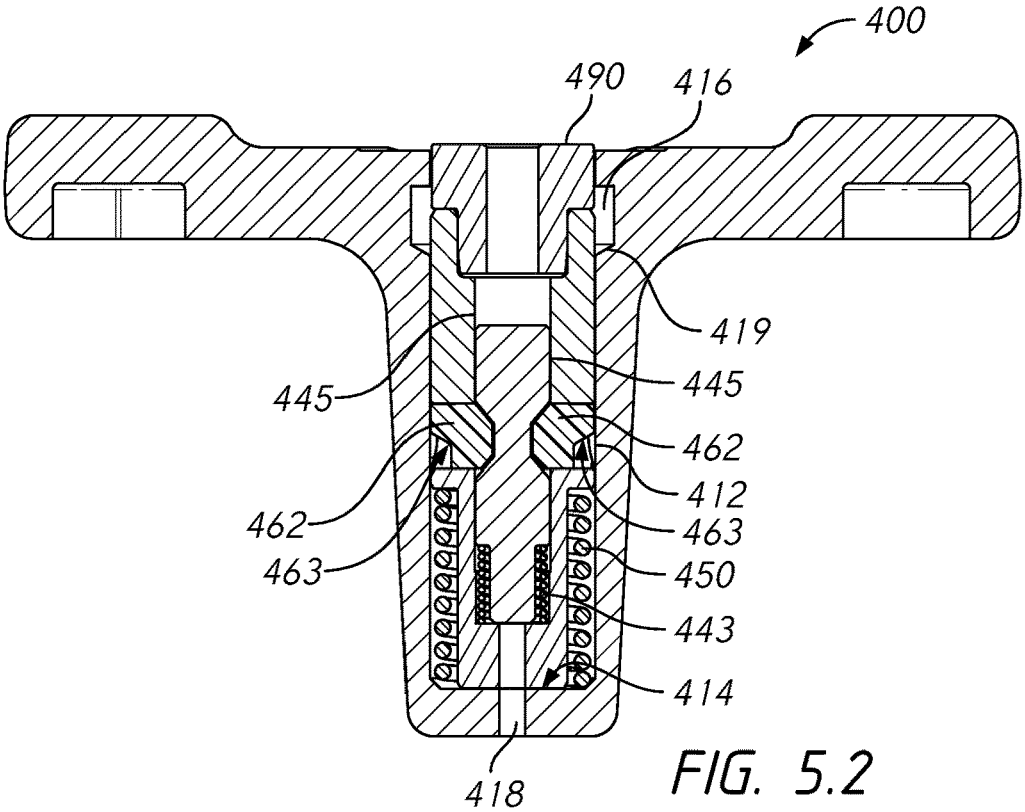
FIG. 5.2

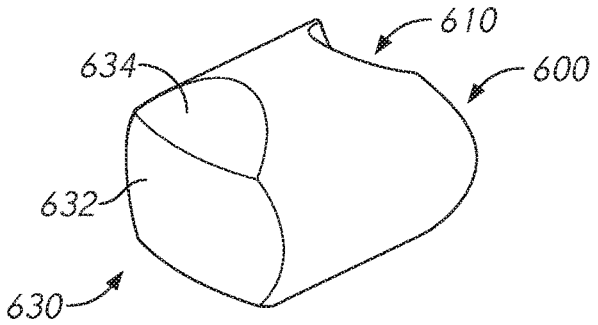
FIG. 6.1
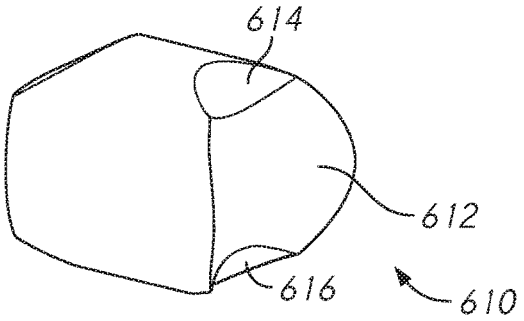
FIG. 6.2
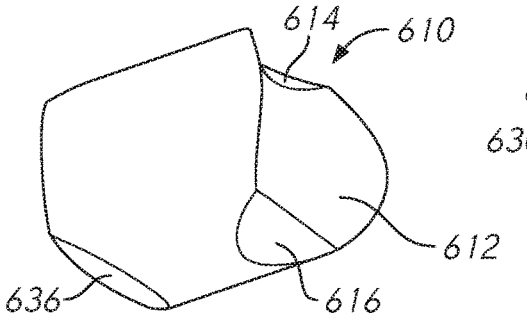
FIG. 6.3
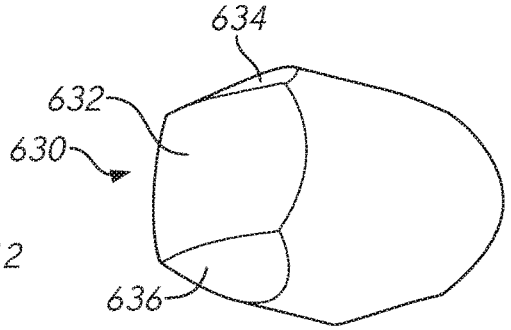
FIG. 6.4
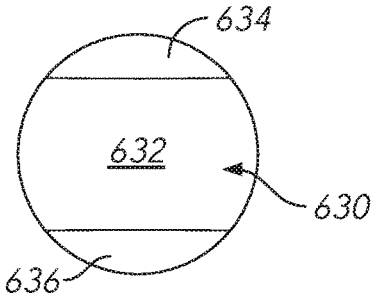
FIG. 6.5
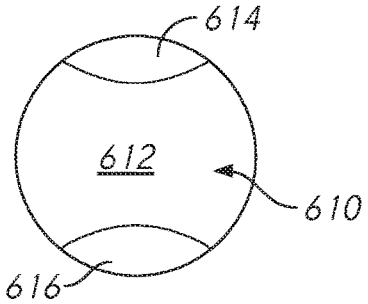
FIG. 6.6
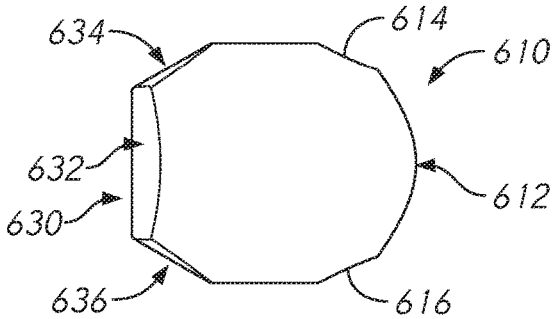
FIG. 6.7
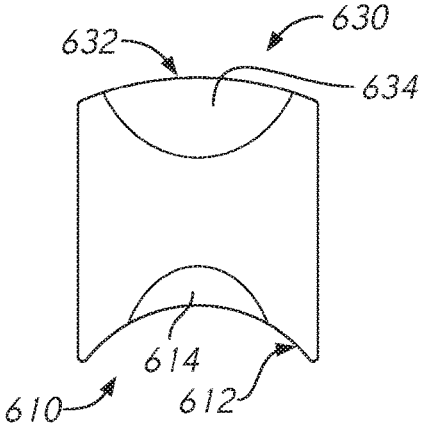
FIG. 6.8

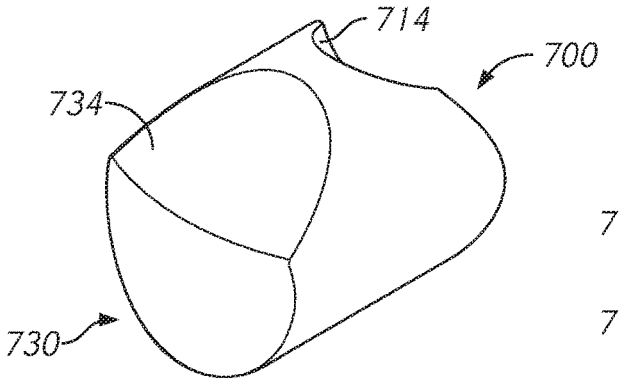
FIG. 7.1
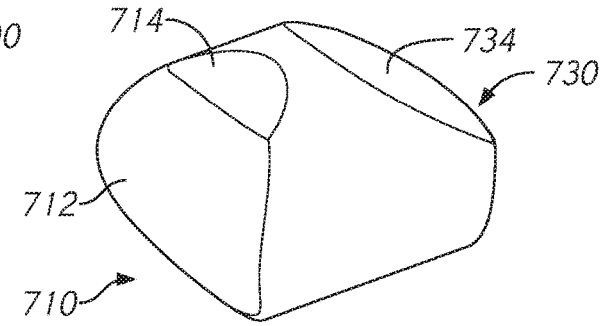
FIG. 7.2
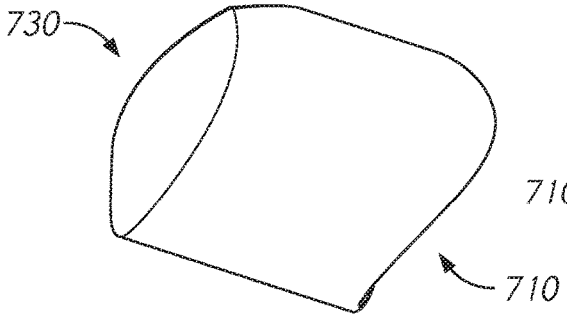
FIG. 7.3
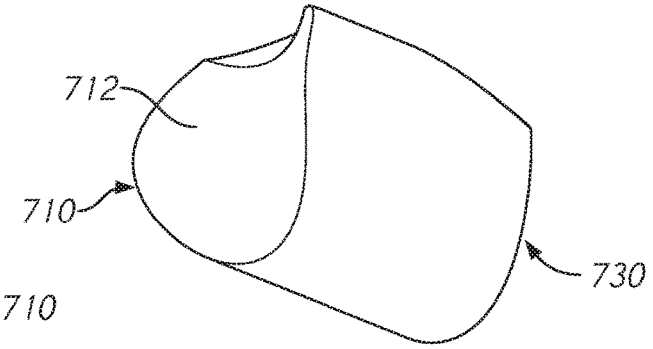
FIG. 7.4
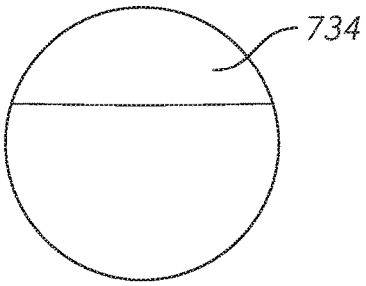
FIG. 7.5
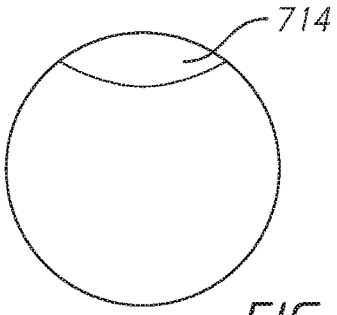
FIG. 7.6
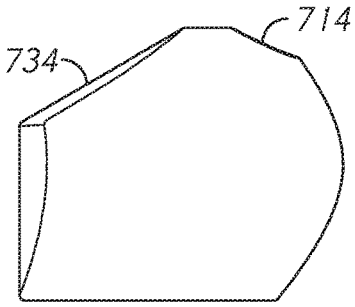
FIG. 7.7
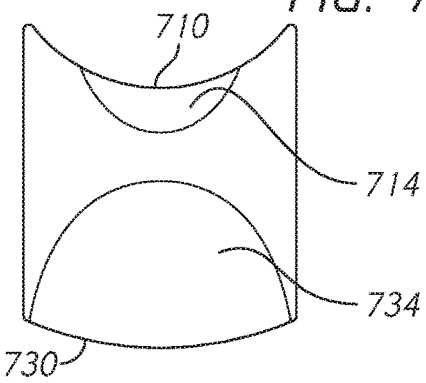
FIG. 7.8

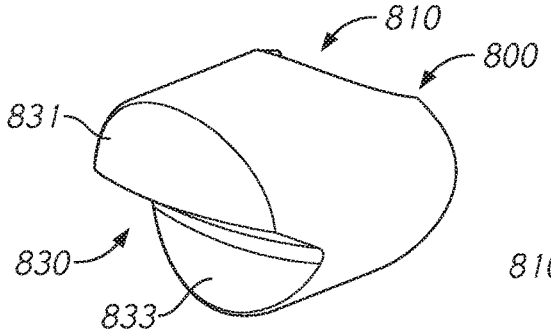
FIG. 8.1
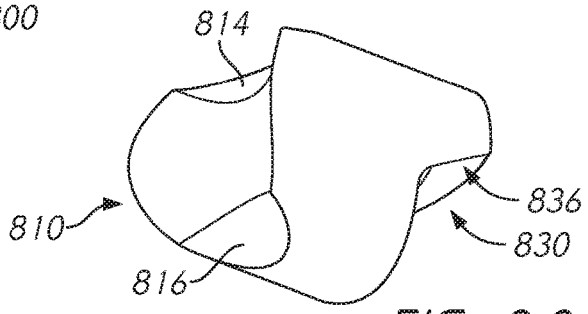
FIG. 8.2
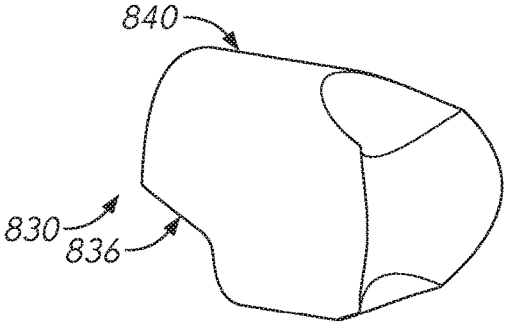
FIG. 8.3
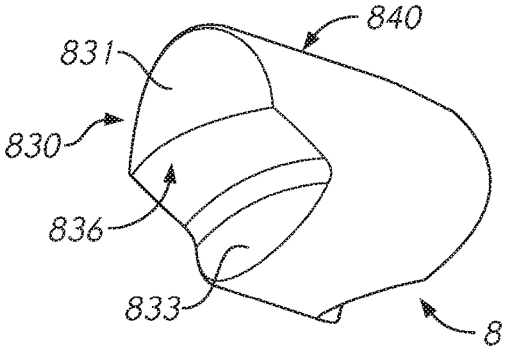
FIG. 8.4
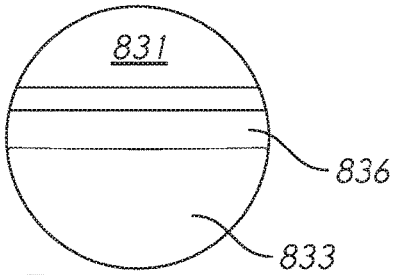
FIG. 8.5
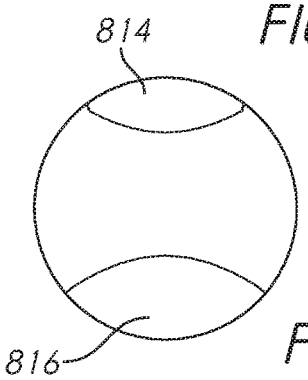
FIG. 8.6
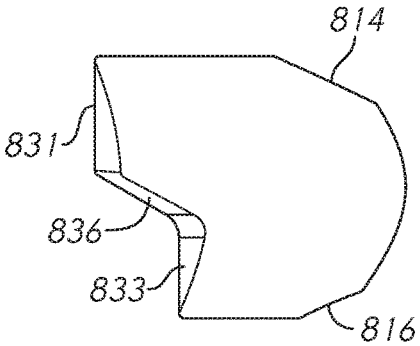
FIG. 8.7
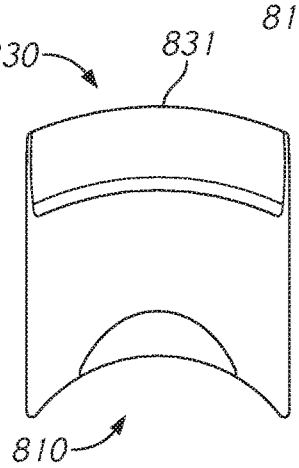
FIG. 8.8
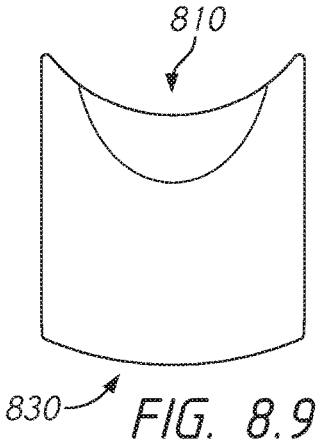
FIG. 8.9

ENGINE VALVE ACTUATION SYSTEMS WITH LOST MOTION VALVE TRAIN COMPONENTS, INCLUDING COLLAPSING VALVE BRIDGES WITH LOCKING PINS

RELATED APPLICATIONS AND PRIORITY CLAIM

The instant application claims priority to U.S. provisional patent application Ser. No. 62/691,947 filed on Jun. 29, 2018 and titled COLLAPSING VALVE BRIDGE WITH PIN ELEMENTS, the subject matter of which is incorporated herein in its entirety.

FIELD

The instant disclosure relates generally to systems for actuating one or more engine valves in an internal combustion engine. In particular, embodiments of the instant disclosure relate to systems and methods for valve actuation using a lost motion system in the form of a collapsing valve train component, such as a collapsing valve bridge.

BACKGROUND

As known in the art, engine valve actuation is required in order to operate an internal combustion engine in a positive power generation mode. Further, auxiliary valve actuation motions (as opposed to "main" valve actuation motions used to operate in positive power generation mode) are known in the art that allow an internal combustion engine to operate in variations of positive power generation mode (e.g., exhaust gas recirculation (EGR)) or in other modes of operation, such as engine braking in which the internal combustion engine is operated essentially as an air compressor to develop retarding power to assist in slowing down the vehicle. Further still, variants in valve actuation motions used to provide engine braking are known (e.g., brake gas recirculation (BGR), bleeder braking, etc.)

To facilitate operation of an internal combustion engine in either positive power or engine braking modes, the use of lost motion components is also known in the art. Such lost motion components typically alter their length or engage/disengage adjacent components within a valve train to permit certain potentially-conflicting valve actuation motions, which are otherwise dictated by fixed-profile valve actuation motion sources such as rotating cams, to be "lost," i.e., not conveyed via the valve train. A particular type of lost motion component known in the art are so-called collapsing (or, alternatively, locking) valve bridges. Examples of such components are taught in U.S. Pat. Nos. 8,936,006, 9,790,824 and European Patent No. 2975230. The subject matter of all of these documents is incorporated herein by reference. In these devices, locking elements are provided that permit a sliding plunger or similar element, disposed within a housing (such as within a centrally-located bore of a valve bridge), to be selectively unlocked (in which case the plunger is free to slide within the bore thereby permitting valve actuation motions applied to the plunger to be lost) or locked (in which case the plunger is maintained in a fixed position relative to the valve bridge thereby permitting valve actuation motions to be conveyed through the plunger to the housing).

While collapsing or locking valve bridges (or other valve train components) operate well for their intended purpose, various improvements thereto would be a welcome addition in the art. More specifically, improvements providing ease of assembly, lower manufacturing cost and more dependable and durable operation of collapsing valve train components, such as collapsing valve bridges, would contribute to the state of the art. It would therefore be advantageous to provide systems that address the aforementioned shortcoming and others in the prior art.

SUMMARY

Responsive to the foregoing challenges, the instant disclosure provides various embodiments of valve actuation systems with features for facilitating locking and unlocking of a collapsing valve train components, such as a valve bridge.

According to aspects of the disclosure, a device for controlling motion applied to the one or more engine valves comprises a housing disposed within the valve train, the housing including a housing bore and at least one housing locking surface, a piston disposed within the housing bore, the piston having a piston bore and at least one locking pin receptacle defined therein, the at least one locking pin receptacle having a cylindrical shape, a locking assembly for selectively locking the piston to the housing, the locking assembly comprising an actuator pin supported for movement within the piston bore and at least one respective locking pin disposed in the at least one locking pin receptacle, the actuator pin including an outer locking pin engagement surface adapted to support the at least one locking pin in an extended position, and an inner locking pin support surface adapted to support the at least one locking pin in a retracted position, whereby movement of the actuator pin causes the at least one locking pin to selectively engage or disengage the housing locking surface thereby selectively locking or unlocking the piston relative to the housing.

According to one example implementation, a valve actuation system may include a collapsing valve bridge including a housing having a housing bore or cavity. A bridge piston is disposed in the housing bore and a locking assembly is disposed in the bridge piston for selectively locking and unlocking the piston for movement relative to the housing. A transverse bore, which may be generally cylindrical in shape and thus easily machined, may extend within the bridge piston and defines receptacles for locking pins of the locking assembly. A locking pin extension spring provides a biasing force on the locking pins tending to force the locking pins in a radially outward direction. Inward travel of the locking pins is limited by an inward travel limiting component, which may be a locking pin inner limit snap ring disposed centrally within the transverse bore. Outward travel of the locking pins may be limited by an outward travel limiting component, which may be in the form of a locking pin outer limit snap ring. The locking pins may include an undercut face on a radially outer surface, which may engage the outer limit snap ring. The undercut face may define a conical surface that engages a corresponding surface in an annular recess of the housing to ensure thorough engagement and load distribution when the piston is locked to the housing. Owing to the cylindrical shape, the locking pins may undergo some degree of rotation within their housings to facilitate alignment. The outer limit snap ring facilitates quick and easy installation of the locking assembly in the bridge piston and prevents significant rotation of the locking pins within the locking pin receptacles. The locking pins may be selectively actuated by control of hydraulic fluid provided through a piston fluid passage in the bridge piston which is in fluid communication with an annular channel formed in the housing bore. When pressurized hydraulic fluid is provided to the piston fluid passage and annular channel an inward force will be presented on radially-outermost surface of the locking pins and force them into a retracted position within the locking pin receptacles, thereby unlocking the bridge piston relative to the housing.

According to another example implementation, a bridge piston includes an actuation pin, which interacts with locking pins to provide synchronized motion and positive positioning thereof in locking and unlocking operations of a valve bridge piston within a valve bridge housing. The housing includes an internal bore in which is positioned a bridge piston for sliding movement relative thereto. Locking pins may be disposed in a transverse cylindrical bore extending through the piston. The piston includes an actuator pin bore for slidably receiving the actuator pin. Hydraulic fluid is conveyed through a fluid passage in a bridge piston cap to an upper surface of the actuator pin to cause downward movement thereof. A return spring returns the actuator pin to an upper indexed position in the absence of fluid pressure. The actuator pin includes an outer locking pin engagement surface for supporting the locking pins in an extended or deployed position in which they engage an annular recess in the bridge housing. The actuator pin also includes an inner locking pin engagement surface for supporting the locking pins in a retracted position. At least one transition surface on the actuating pin may be conical in shape and may extend from the outer locking pin engagement surface to the inner locking pin engagement surface. The locking pins may include an actuating pin interface with alignment surfaces for engaging the actuator pin and for aligning and preventing rotation of the locking pins in the deployed position, in the retracted position and during movement between the deployed and retracted positions. The alignment surfaces may include one or more conical chamfers on the locking pins adapted to cooperate with the transition surface(s) as the locking pin moves inward toward the actuation pin and to ultimately engage the transition surface of the actuating pin to provide for stable support of the locking pin in the retracted position. One or more conical surfaces on a housing interface of the locking pins may engage corresponding surfaces in an annular recess of the housing to ensure thorough engagement and load distribution when the piston is locked to the housing.

According to yet another example implementation, collapsing valve bridge locking pins comprise an actuation pin interface having a first concave surface for engaging the actuator pin outer locking pin engagement surface and a pair of conical chamfered surfaces for engaging respective transition surfaces on the actuator pin. A housing interface on the locking pins includes an outer convex surface and pair of opposed, symmetrical conical convex surfaces on top and bottom portions of the locking pins for providing effective engagement with one or more correspondingly shaped conical surfaces on an annular recess of the housing.

According to yet another example implementation, collapsing valve bridge locking pins may comprise an actuation pin interface having a first concave surface for engaging the actuator pin outer locking pin engagement surface and a single conical chamfered surface on an upper portion of the locking pin for engaging a transition surface on the actuation pin. A housing interface on the locking pins includes an outer convex surface and a single conical convex surface on a top portion of the locking pin.

According to yet another example implementation, collapsing valve bridge locking pins may comprise an actuation pin interface having a first concave surface for engaging the actuator pin outer locking pin engagement surface and a two, opposed, asymmetrical, conical chamfered surfaces on an upper and lower portion of the locking pin for engaging respective transition surface on the actuation pin. The asymmetrical conical chamfered surfaces prevent the locking pin from properly seating against the actuation pin inner locking pin engagement surface when the locking pin is upside down or improperly oriented, thus preventing improper assembly of the locking pin in the piston transverse bore. A housing interface on the locking pins includes an outer convex surface and an undercut portion forming a conical surface for engaging a correspondingly shaped conical surface on the piston bore annular recess. The undercut housing interface on the locking pin provides advantageous alignment and load distribution relative to the piston bore annular recess.

Other aspects and advantages of the disclosure will be apparent to those of ordinary skill from the detailed description that follows and the above aspects should not be viewed as exhaustive or limiting. The foregoing general description and the following detailed description are intended to provide examples of the inventive aspects of this disclosure and should in no way be construed as limiting or restrictive of the scope defined in the appended claims.

DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples according to aspects of the disclosure and are not intended to be limiting to the scope of invention, which is set forth in the claims appended hereto. In the following descriptions of the figures, all illustrations pertain to features that are examples according to aspects of the instant disclosure, unless otherwise noted.

FIG. 5.1 is a cross-section of the example collapsing valve bridge of FIG. 4, shown assembled and in a locked position. FIG. 5.2 is a cross-section of the example collapsing valve bridge of FIG. 4 shown assembled and in an unlocked position.

FIGS. 6.1 to 6.4 are perspective views of an example locking pin suitable for use in a collapsing valve bridge. FIGS. 6.5 to 6.8 are views of a locking end, actuated end, side and top, respectively, of the example locking pin of FIGS. 6.1 to 6.4.

FIGS. 7.1 to 7.4 are perspective views of another example locking pin suitable for use in a collapsing valve bridge. FIGS. 7.5 to 7.8 are views of a locking end, actuated end, side and top, respectively, of the example locking pin of FIGS. 7.1 to 7.4.

FIGS. 8.1 to 8.4 are perspective views of another example locking pin suitable for use in a collapsing valve bridge.

FIGS. 8.5 to 8.9 are views of a locking end, actuated end, side, bottom and top, respectively, of the example locking pin of FIGS. 8.1 to 8.4.

DETAILED DESCRIPTION

Figure 1:
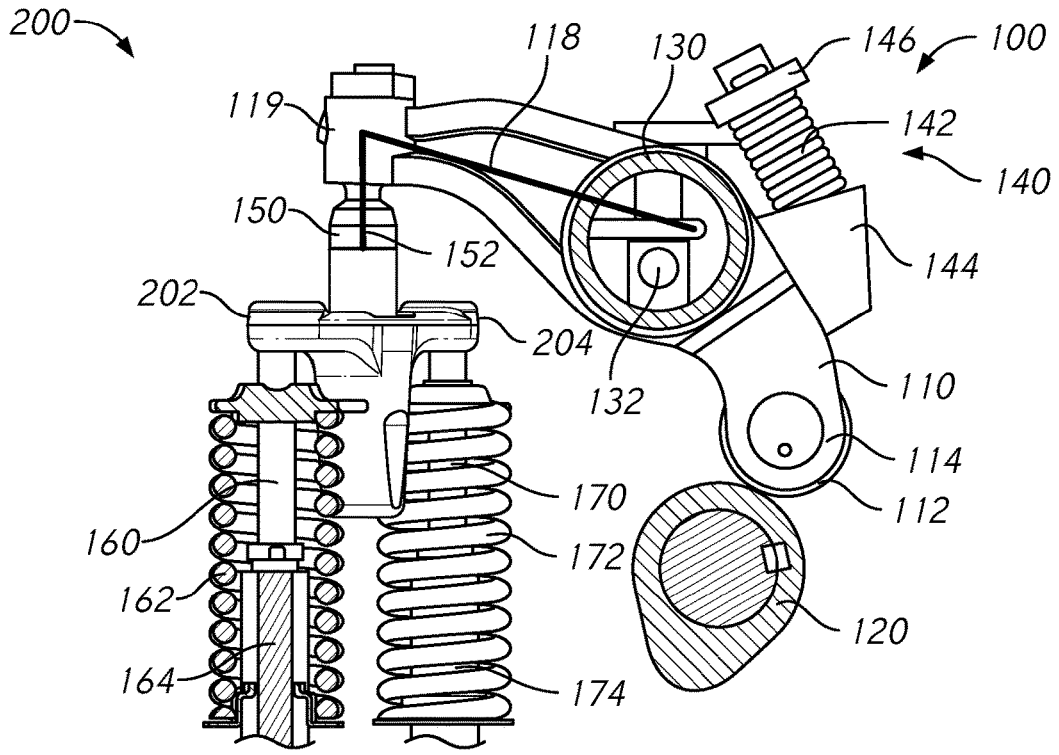
FIG. 1 illustrates an example engine valve actuation system that utilizes a lost motion device in the form of a collapsing valve bridge.

FIG. 1 is a pictorial illustration of a valve actuation system 100, including a valvetrain with a lost motion device in the form of a collapsing valve bridge 200. The system may include a rocker arm 110, which may receive valve actuation motions from a suitable valve actuation motion source, such as a cam 120. As is known, the rocker arm may be supported for pivoting movement on a rocker shaft 130, which may include one or more hydraulic fluid passages 132 extending therein for supplying hydraulic fluid to the rocker arm. A cam roller 112 may be disposed at a cam roller end 114 of the rocker 110 and may interact with the surface of the cam 120 to convey the motion of the cam surface to the rocker 110. A biasing mechanism 140, which may include a spring 142 acting against a rocker arm ledge or extension 144 and secured to a stationary mount 146 affixed to the engine block or head, may bias the rocker 110 toward the motion source 120 and maintain the cam roller 112 in contact with the cam.

As illustrated schematically in FIG. 1, one or more hydraulic fluid delivery channels 118 may extend within the interior of the rocker 110 to deliver hydraulic fluid from the rocker shaft hydraulic passage 132 to a valve bridge end 119 of the rocker 110. The hydraulic fluid may pass from the delivery channel 118 through additional components in the valve train, such as a swivel foot 150, having an internal passage 152, and further to internal working components of the valve bridge, as will be detailed herein. Opposing valve-engaging ends 202 and 204 of the valve bridge 200 may engage respective engine valves 160 and 170, or other components, such as bridge pins, that ultimately control motion of the engine valves. Each valve 160, 170 may include a valve spring 162, 172 to bias the valve in a closed position and may provide a biasing force on the valve bridge tending to move the valve bridge in an upward direction, and thus also providing a biasing force tending to keep the cam roller 112 against the cam 120, as is known in the art. Valves 160, 170 may be guided within valve guides 164, 174, which may be supported on and fixed to the engine cylinder head or engine block.

Figure 2:
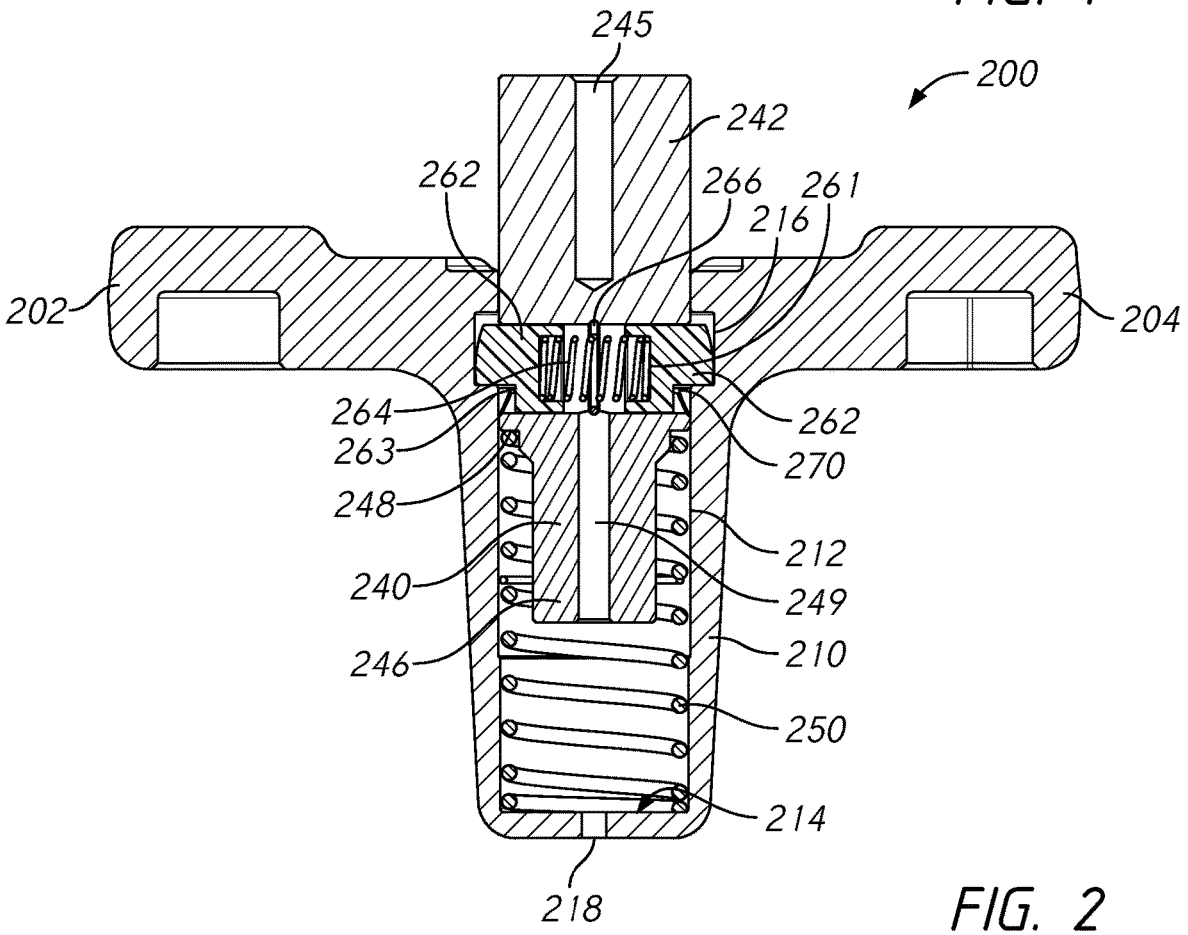
FIG. 2 is a cross-section of an example collapsing valve bridge suitable for use in the system of FIG. 1.
Figure 3:
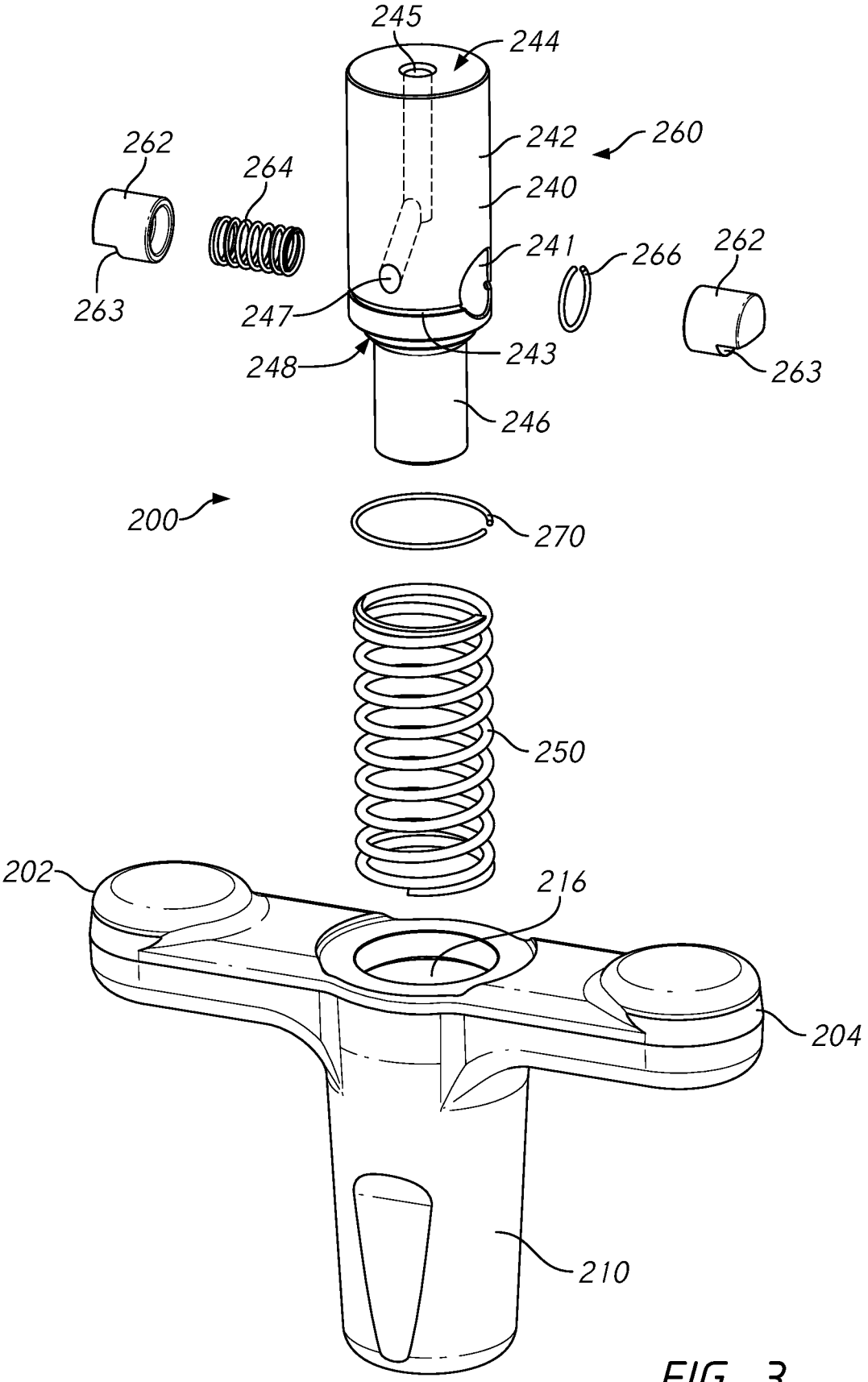
FIG. 3 is an exploded view of the collapsing valve bridge of FIG. 2.

FIGS. 2 and 3 illustrate components of a first example collapsing valve bridge 200 according to aspects of the disclosure. FIG. 2 is an assembled cross-section view and FIG. 3 is an exploded perspective view of the valve bridge components. The collapsing valve bridge 200 may include a housing 210 having a housing bore or cavity 212 defined in a central portion thereof. Opposing valve-engaging ends 202 and 204 of the housing 210 may extend from the central portion. A bridge piston or plunger 240 may be disposed in the housing bore 212 and may include an upper portion 242 having a valve train engaging interface 244 for engaging a valve train component, such as swivel foot 150 (FIG. 1). Bridge piston 240 may also include a lower portion 246 having a spring seat 248 defined therein for engaging a piston return spring 250, an opposite end of which may be seated against a bottom wall 214 of the housing bore 212.

According to aspects of the disclosure, a locking assembly 260 may be disposed in the bridge piston 240 for selectively locking and unlocking the piston 240 for movement relative to the housing 210. A transverse or radially-extending bore 241, which may be generally cylindrical in shape and thus easily formed, may extend within the bridge piston 240 and thus may provide respective, axially aligned locking pin housings or receptacles. Locking assembly 260 may include a pair of opposed locking pins 262 disposed in the transverse bore 241. A locking pin extension spring 264 may be provided in the transverse bore 241 between the two locking pins 262 and may provide a biasing force on the locking pins tending to force the locking pins in a deployed or locking direction radially outward from the axis or center of the bridge piston 240. Each locking pin 262 may include a recessed spring seat 261 formed on an inner surface thereof to engage the spring 264. Inward travel of the locking pins 262 may be limited by an inward travel limiting component, which may be in the form of a locking pin inner limit snap ring 266 disposed centrally within the transverse bore. Locking pin inner limit snap ring 266 may thus also serve to minimize any potential for one of the locking pins 262 to be fully retracted while the other locking pin is only partially retracted.

Outward travel of locking pins 262 may be limited by an outward travel limiting component, which may be in the form of a locking pin outer limit snap ring 270 disposed in a retaining groove 243 and having an outer diameter that substantially matches that of the bridge piston. As will be recognized, locking pins 262 may include an undercut face 263 on an outer surface thereof, which, in addition to providing advantages in engaging and locking the bridge piston to the housing 210, as will be detailed further herein, may engage the outer limit snap ring 270 when installed in groove 243 to define an outer travel limit of the locking pins 262. As will be recognized, outer limit snap ring 270 facilitates easy assembly of the locking pins 262 within the bridge piston 240. The inner limit snap ring 266, spring 264 and locking pins 262 may be installed in transverse bore 241 and held in a retracted position manually or with manufacturing equipment while the outer limit snap ring 270 may be fit onto the bridge piston 240 and positioned into groove 243. The outer limit snap ring 270 facilitates quick and easy installation of the locking assembly 260 in the bridge piston 240 and also serves as a locking pin travel limiting component to provide an outer limit on the travel of the locking pins 262. Still further, the outer limit snap ring prevents significant rotation of the locking pins 262 within the locking pin receptacles 241 and thus operate to maintain the locking pins 262 in a proper orientation.

Locking pins 262 may be selectively actuated by control of hydraulic fluid provided to the collapsing piston bridge 200. A piston fluid passage 245 may be provided in the bridge piston 240 and may receive hydraulic fluid via a hydraulic fluid source and passages in the valve train, such as the passage 152 in the swivel foot 150 (FIG. 1), which in turn is fed hydraulic fluid via the rocker delivery passage 118

(FIG. 1). As best seen in FIG. 3, an upper section of piston fluid passage 245 may extend axially within the piston 240 and a lower portion of piston fluid passage 245 may extend radially outward to an outlet 247.

When the piston is installed in the piston bore 212, outlet 247 may be in fluid communication with an annular channel 216 formed within the lateral surface of the piston bore 212. Locking pins may be controlled through application of pressurized hydraulic fluid in the piston fluid passage and annular channel 216. When pressurized hydraulic fluid is provided to the piston fluid passage 245 and annular channel 216, for example, by way of a control solenoid, as is generally known in the art, controlling fluid in the hydraulic passages in the valve train, an inward force will be presented on radially-outermost surface of the locking pins 262 and will be sufficient to overcome the bias of the locking pin extension spring 264. Consequently, the locking pins 262 will be forced into a retracted position within the locking pin receptacles 241 and out of contact with the annular channel 216, thereby unlocking the bridge piston 240 relative to the housing 210 and permitting the piston 240 to move within the housing bore 212, with the corresponding loss of motion in the valve train. Piston 240 may include a piston vent passage 249, which may vent hydraulic fluid from within the transverse bore 241 to the bottom of the housing bore 212. A housing vent passage 218 permits vented hydraulic fluid to exit the bottom of the housing 210. This arrangement prevents the buildup of hydraulic fluid in the transverse bore 241 behind (i.e., on the radially inward surfaces of) the locking pins 262.

As will be recognized from the instant disclosure, when the piston fluid passage 245 is not charged with pressurized hydraulic fluid, for example, when the control solenoid valve shuts off the flow of hydraulic fluid, bias of the piston return spring 250 may cause the bridge piston 240 to index upward within the housing bore 212 until the transverse bore 241 registers with the annular channel. At that point, the bias of the locking pin extension spring 264 is sufficient to cause the locking pins 262 to extend into the annular channel 216, thereby locking the bridge piston 240 relative to the housing 210.

As can best be seen in FIG. 2, the undercut face 263 of the locking pins 262 may provide for alignment of the locking pins 262 with the annular channel 216 as the locking pins 262 move into the deployed position. In addition, the upper extending portion of the locking pins 262 may have a dimension that permits sufficient clearance with an upper surface of the annular channel 216 in order to prevent binding when the locking pins 262 move to the deployed position. As will be recognized, the cylindrical shape of the locking pins 262 may permit rotational movement of the locking pins 262 within the correspondingly-shaped locking pin receptacles 241. On the other hand, some limit on the extent of rotation of the locking pins 262 within the locking pin receptacles may be provided by the outer limit snap ring 270. Thus, in accordance with aspects of the disclosure, the locking pins 262 are permitted sufficient rotation to facilitate self-alignment with the annular channel 216, but not such a degree of rotation that would result in misalignment or interference of movement of the locking pins 262 as they move to a deployed position.

Figure 4:
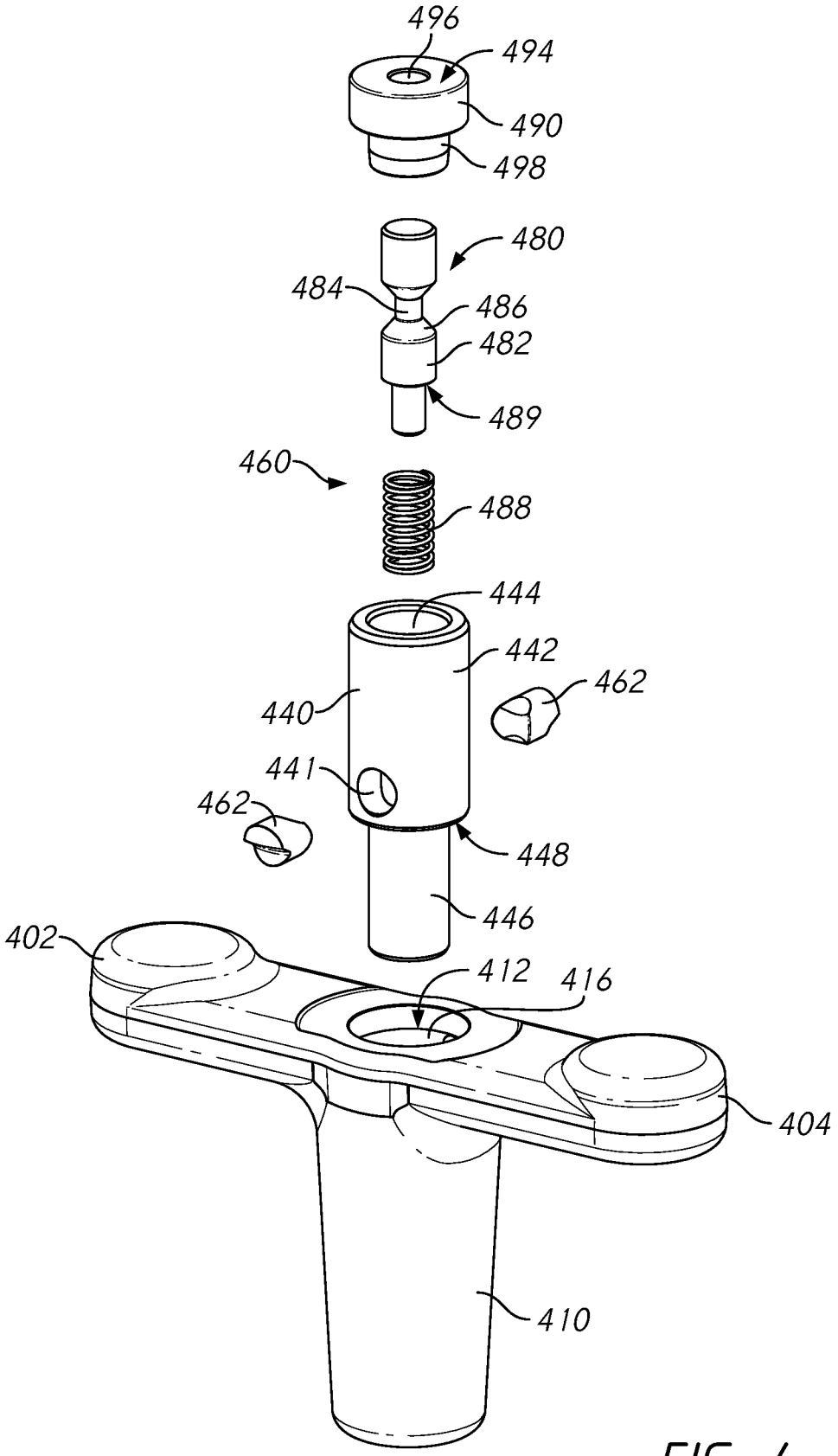
FIG. 4 is an exploded view of another example collapsing valve bridge according to further aspects of the disclosure.
Figure 9:
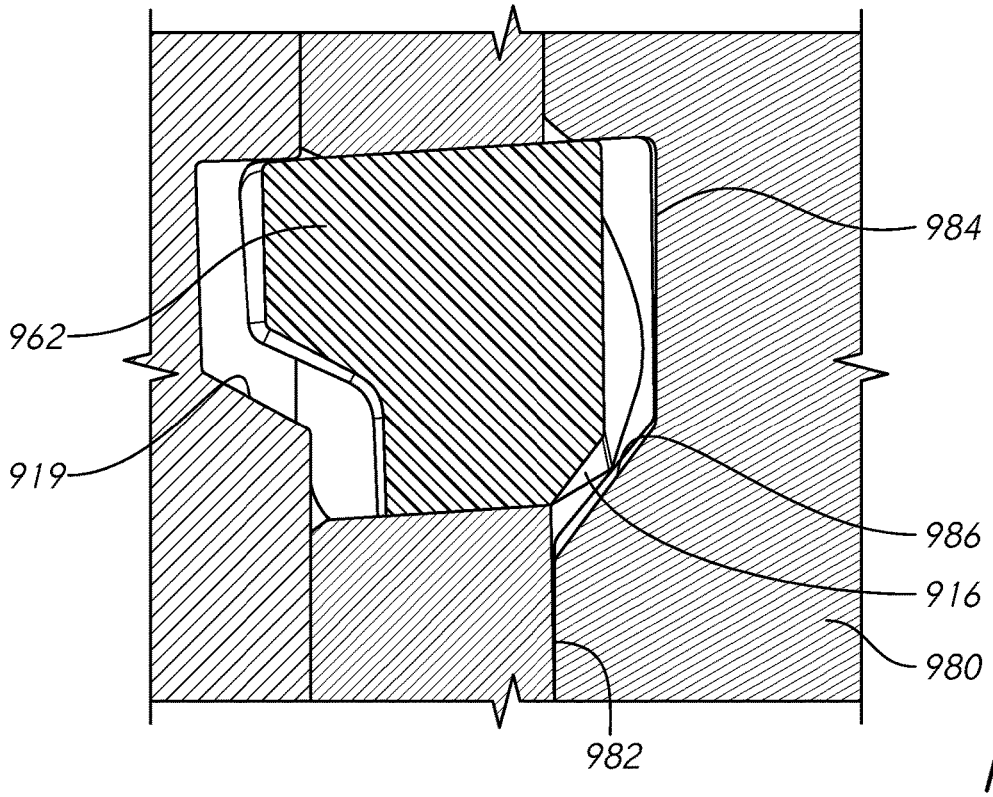
FIG. 9 is a cross-section showing an example locking pin disposed in a locking pin receptacle with an alignment surface interacting with an actuation pin in a collapsing valve bridge.

FIGS. 4, 5.1 and 5.2 illustrate an alternative embodiment of a collapsing bridge 400 according to aspects of the disclosure. According to these aspects, positive positioning and synchronized motion of locking pins 462 is facilitated by an actuation pin 480 disposed within the piston 440. The collapsing bridge may include a housing 410, which in this case is in the form of a valve bridge, having an internal housing bore or cavity 412 defined in a central portion thereof and including an annular recess 416 extending into a surface of the housing bore 412. Opposing valve-engaging ends 402 and 404 of the housing 210 may extend from the central portion. A bridge piston or plunger 440 may be disposed in the housing bore 412 and may include an upper portion 442. A bridge piston cap 490 may include a valve train engaging interface 494 for engaging a valve train component, such as swivel foot 150 (FIG. 1) and a bridge piston cap fluid passage 496 extending through the bridge piston cap 490. A reduced diameter bridge piston cap plug 498 may fit within a bridge piston cap plug receiving bore 444 on the bridge piston. Bridge piston 440 may also include a lower portion 446 having a spring seat 448 defined thereon for engaging a piston return spring 450, an opposite end of which may be seated against a bottom wall 414 of the housing bore 412. Piston return spring 450 applies a biasing force to piston 440 tending to move the piston 440 in an upward direction. A housing vent 418 permits the flow of hydraulic fluid from the housing bore 412.

According to aspects of the disclosure, a locking assembly 460 may be disposed in the bridge piston 440 for selectively locking and unlocking the piston 440 for movement relative to the housing 410. A transverse or radially-extending bore 441, which may be generally cylindrical in shape and thus easily formed, may extend within the bridge piston 440 and thus may provide respective, axially aligned locking pin housings or receptacles. Locking assembly 460 may include a pair of opposed locking pins 462 disposed in the respective locking pin receptacles forming the transverse bore 441.

Piston 440 may include an actuation pin receiving bore 445 for receiving actuation pin 480. Actuation pin 480 may include an outer actuation pin engagement surface 482, which may be a cylindrical portion of the actuation pin having a diameter substantially corresponding to the internal diameter of actuation pin receiving bore 445. Actuation pin 480 may also include an inner actuation pin engagement surface 484, which may be a reduced diameter cylindrical portion compared to the outer actuation pin engagement surface 482. One or more conical, chamfered or otherwise tapered transition surfaces 486 may extend between the inner actuation pin engagement surface 484 and the outer actuating pin engagement surface 482. Actuation pin 480 may cooperate with an actuation pin return spring 488, which at one end may engage an actuation pin spring seat 489 formed on the actuation pin. An opposite end of actuation pin return spring 488 may be housed within an actuation pin return spring cavity 443 defined within the bridge piston 440 and may engage an end wall 447 thereof. As will be recognized, actuator return spring 488 provides a biasing force on the actuation pin 480 tending to move the actuation pin 480 to the position shown in FIG. 5.1, which is a locked mode of operation.

Actuation pin 480 may be moved downward, against the bias of actuation pin return spring 488 under control of hydraulic fluid entering the bridge piston cap fluid passage 496 and acting upon an upper surface of the actuation pin 480. This motion transitions the collapsing bridge 400 from a locked state, shown in FIG. 5.1, to an unlocked state, shown in FIG. 5.2. As shown particularly in FIG. 5.1, when the outer actuation pin engagement surface 482 is in contact with the inner surfaces of the locking pins 462, the locking pins 462 are extended into contact with the annular channel 416 of the housing 410 and positively maintained in that position by surface-to-surface contact by the actuation pin 480. Downward movement of the actuation pin 480 from the position shown in FIG. 5.1 results in alignment of the actuation pin inner engagement surface—the reduced diameter portion of actuation pin 480—aligning with the inner surfaces of the locking pins 462, thereby permitting retraction of the locking pins 462 into opposing ends of transverse bore 441 and unlocking of the bridge piston 440 relative to the housing 410, as shown in FIG. 5.2. The motive force for the inward motion of locking pins 462 may be provided by the surface geometry of the locking pins 462, particularly where they interface with the lower surface of the annular channel 416 such that downward force on the piston 440 by the valve train components causes a net inward force on the locking pins 462. That is, the lower surface 419 of channel 416 and the undercut surface 463 of the locking pins 462 may extend at such an angle to an axis of the piston axis that downward force on the piston 440 results in inward movement of the locking pins 462 if the actuation pin 480 is in the unlocked position. For example, as disclosed in European Patent No. 2975230, the undercut surface 463 of the locking pins 462 and the lower surface 419 of the annular recess 416 may be defined according to a cone frustum such that engagement of these complementary surfaces induces the net inward force on the locking pins 462.

As will be recognized from the instant disclosure, the use of an actuation pin 480 as shown in FIGS. 4, 5.1 and 5.2 provides for positive positioning and synchronized movement of the locking pins 462. This may offer additional improvements over the embodiment described above with reference to FIGS. 2 and 3, as the potential scenario in which either or both of the locking pins are either partially engaged or disengaged due to the independent nature in which each are controlled is eliminated. More particularly, the potential for one of the locking pins to remain partially engaged while the other locking pin is fully disengaged, and the associated stress concentration and potential damage to the locking pins or other components is eliminated by the synchronization and positive positioning features of the embodiment of FIGS. 4, 5.1 and 5.2. Because the reduced diameter portion of the actuation pin 462 will simultaneously engage or disengage with the locking pins 462, the likelihood of partial engagements/disengagements is significantly reduced if not eliminated altogether.

According to further aspects of the disclosure, various geometries and configurations for the locking pins and actuation pin used in a collapsing valve train component may provide additional advantages, especially with regard to alignment, ease of manufacture and assembly of locking pins, actuating pin, and the collapsing valve train components generally contemplated herein. Examples of such geometries and configurations are illustrated in FIGS. 6.1 to 6.8, 7.1 to 7.8, 8.1 to 8.9, and FIGS. 9-12. Generally, as shown in these figures and further detailed herein, the locking pins may comprise a generally cylindrical body having a circular, oval or elliptical cross-section. As used herein, both in the preceding and following description, the term "cylindrical" is intended to (and should be interpreted to) include shapes that may have circular, oval or elliptical cross-sections. As will be recognized, while non-circular-shaped (or even substantially rectangular) locking pins are less likely to rotate within the transverse bore, substantially circular-shaped locking pins are advantageous to the extent that the transverse bore 241, 441 may be relatively easier and less expensive to produce in comparison to a non-circular, such as an oval- or rectangle-shaped transverse bore. The locking pins may have an actuation pin interface at one end, which may comprise one or more concave actuation pin engaging surfaces, and a housing interface at an opposite end, which may comprise one or more convex housing engaging surfaces.

The concave actuation pin engaging surfaces of the actuation pin interface of the locking pins may be configured to complementarily engage the outer actuation pin engagement surface (i.e., 482 in FIG. 4)—the outer diameter—of the actuation pin as described above. In this manner, the concave actuation pin engaging surfaces of each locking pin may operate as alignment surfaces to ensure alignment of the locking pins with the actuation pin and to prevent excessive rotation of the locking pin when in the retracted and in the deployed positions and when moving from a retracted position to a deployed or extended position out of the transverse bore and vice versa. Likewise, the convex housing engaging surfaces of the housing interface of the locking pins may be configured to complementarily engage surfaces of the annular channel formed in housing (i.e., the valve bridge body).

Referring collectively to FIGS. 6.1 to 6.8, FIGS. 6.1 to 6.4 are isometric views and FIGS. 6.5 to 6.8 are orthographic projected views of an outer end, inner end, side and top of an example embodiment of a locking pin 600. The locking pin 600 may have a generally cylindrical shape and may include an actuation pin interface 610 on the inner end and a housing interface 630 on an outer end. Actuating pin interface 610 may include a first actuating pin engagement surface 612 formed as a concave surface having a radius that is sufficient to accommodate the outer diameter of the outer locking pin engagement surface (i.e., 482 in FIG. 4) of the actuating pin 480, thus providing stable engagement of the locking pin 600 with the actuating pin when the locking pin is in an extended position. In this regard, actuating pin engagement surface 612 also functions as an alignment surface to keep the locking pin aligned with the actuating pin when the locking pin is in the extended position. Actuating pin interface 610 may further include second and third actuator pin engagement surfaces 614 and 616 on an upper and lower portion, respectively, of the actuating pin interface 610. The second and third actuator pin engagement surfaces 614 and 616 may each comprise a conical, chamfered surface that may extend at an angle to the actuating pin axis and be adapted to engage respective transition surfaces (i.e., 486 in FIG. 4) on the actuating pin 480. Conical surfaces 614 and 616 may serve as a mechanism for maintaining alignment and preventing rotation of the locking pins within the transverse bore, particularly as the locking pins move from an extended position to the retracted position. Such alignment and anti-rotation function is illustrated in more detail in FIG. 9, where the conical transition 986 of the actuation pin 980 is about to be engaged by a conical chamfered alignment surface 916 of locking pin 962. In the example shown in FIG. 9, only one conical alignment surface is provided on the locking pin and only one transition surface is provided on the actuating pin 980.

Alignment surface 916 is adapted to guide and prevent rotation of the locking pin 962 during its entire travel from the extended position in engagement with the outer locking pin engagement surface 982 of actuating pin 980 to the retracted position in which locking pin is in engagement with the inner locking pin engagement surface 984 of actuating pin 480. Stated another way, when these two conical surfaces, 916 and 986, engage each other (as in the case where the actuation pin is sliding to cause locking of the bridge piston), their complementary shapes urge alignment of the locking pin with the actuation pin, thereby preventing or at least minimizing rotation of the locking pin.

Housing interface 630 of locking pin 600 may include an outer concave surface 632 and two housing engagement surfaces 634 and 636. Housing engagement surfaces 634 and 636 may engage one or respective chamfered surfaces in the annular channel in the housing bore (i.e., 419 in FIG. 5.1 or 919 in FIG. 9). Housing engagement surfaces 634 and 636 may be defined according to a cone frustum or conical frustum and may engage a correspondingly shaped surface in the annular channel in the housing bore. This shape of the housing engagement surfaces 634 and 636, together with the shape of the surfaces on the annular channel, not only provide for alignment and anti-rotation of the locking pins when moving to the extended position, but facilitate inward force on and movement of the locking pins to the retracted position when the actuating pin is in an unlocked position and the bridge piston is subject to downward valve train forces.

Referring collectively to FIGS. 7.1 to 7.8, there is illustrated another example embodiment of a locking pin 700 according to aspects of the disclosure. In this embodiment, the actuating pin interface 710 includes a first engagement surface 712 for engaging the outer locking pin engagement surface of the actuating pin 480 (FIG. 4) and a single chamfered conical surface 714 on an upper portion of the actuating pin interface 710. The housing interface 730 of the locking pin 700 is similarly provided with a single conical surface 734 on an upper portion of the housing interface 730.

Figure 11:
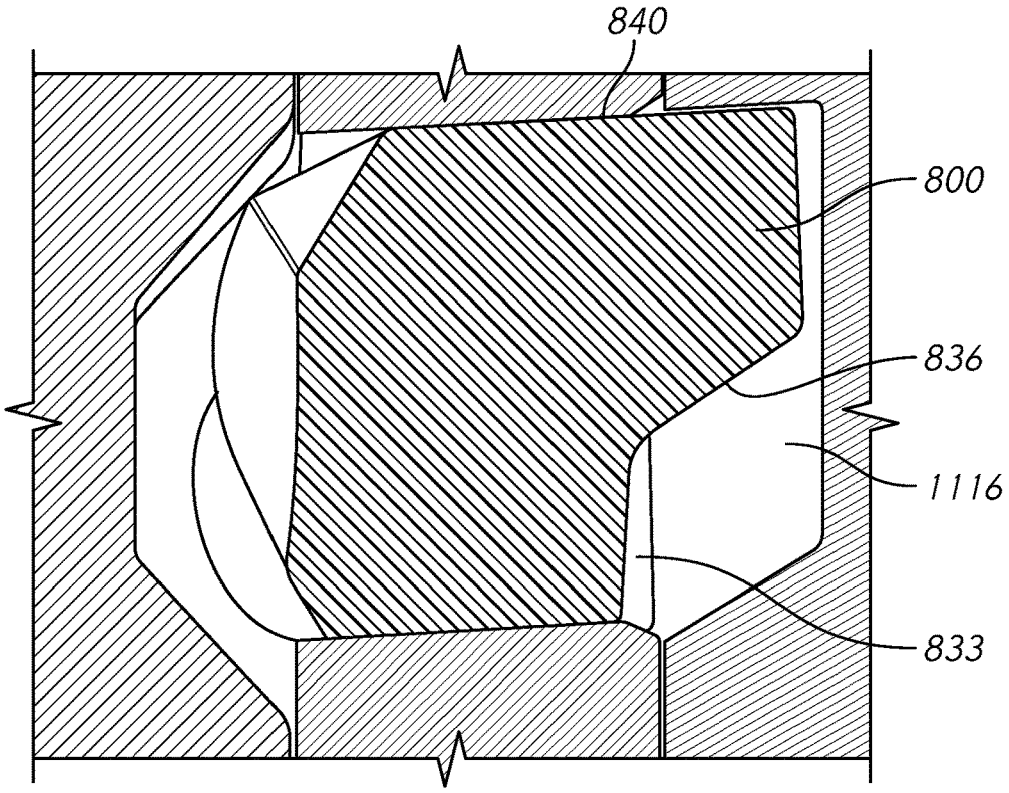
FIG. 11 is a cross-section showing the example locking pin of FIGS. 8.1 to 8.9 disposed in a locking pin receptacle and showing alignment surfaces interacting with the actuation pin to prevent rotation.

FIGS. 8.1 to 8.9 collectively illustrate another example embodiment of a locking pin 800 according to aspects of the disclosure. In this embodiment, locking pin 800 is provided with two conical chamfered alignment surfaces 814 and 816 on an actuating pin interface 810. Locking pin 800 is also provided with an undercut housing interface 830, including an outer convex end surface 831, conical housing engagement surface 836 and a reduced diameter convex inner end surface 833. In this example, a lower portion of the convex end surface (e.g., half or more of the thickness of the lock pin) is removed to form the conical surface 836 transitioning between the outermost convex end surface 831 and a reduced diameter convex inner end surface 833. The resulting projection, as best shown in FIG. 11, preferably has surfaces that closely match the curvatures of the annular channel. In this manner, the conical transition surface on the locking pin 800 is able to relatively broadly engage a corresponding surface of the annular channel, thereby better dispersing the applied forces and minimizing the likelihood of damage to the components. This configuration also provides alignment benefits with regard to alignment of the housing interface 830 with the annular channel. Particularly, the undercut housing interface 830 provides an extended guiding surface 840 that extends above the housing engagement surface 836. As will be recognized by the instant disclosure, provision of a relatively broad and flat or conical surface on the locking pin in this manner may better distribute the substantial forces applied to the locking pin when it is extended into and in contact with a similarly broad and flat or conical surface of the annular channel.

Figure 10:
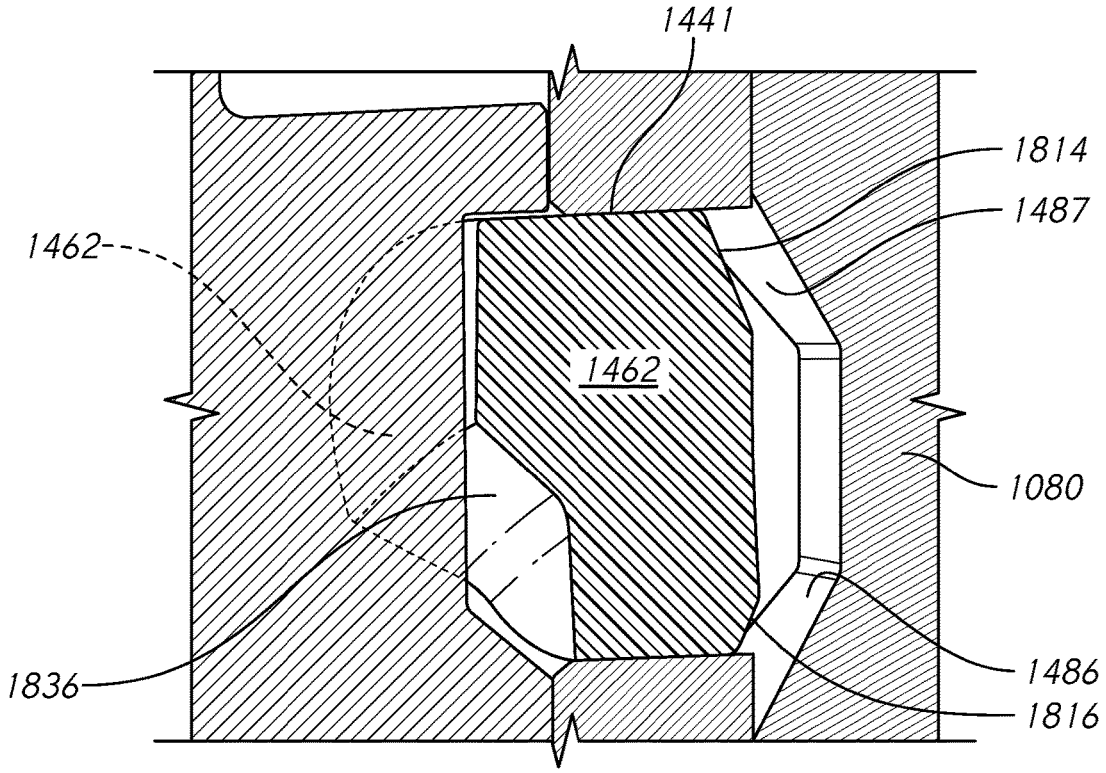
FIG. 10 is a cross-section showing the example locking pin of FIGS. 8.1 to 8.9 disposed in a locking pin receptacle, showing alignment surfaces interacting with the actuation pin to prevent rotation.

A further advantage of the double conical chamfered surfaces on the actuating pin interface according to aspects of the disclosure, such as the surfaces 814 and 816 in the embodiment of FIG. 8, and the surfaces 614 and 616 in the embodiment in FIG. 6, is improved alignment and anti-rotation of the locking pin. Referring additionally to FIG. 10, such configurations are used in conjunction with actuating pins, such as actuating pin 1080, which has dual transition surfaces 1486 and 1487 cooperating with the conical chamfered surfaces on the locking pin 1814 and 1816 is improved alignment and anti-rotation features of the locking pin. More specifically, FIG. 10 shows the extent of rotation of locking pin 1462 (and the degree of misalignment of conical housing engagement surface 1836) permitted within the locking pin receptacle (transverse bore) before rotation of the locking pin 1462 is limited by the chamfered surfaces 1816 and 1814. As will be recognized, the double conical chamfered surfaces 1816 and 1814 may prevent the locking pin 1462 from rotating to a degree that would prevent the projected portion of the locking pin from entering the annular channel on the housing, thus ensuring proper alignment and operation of the locking pin.

Figure 12:
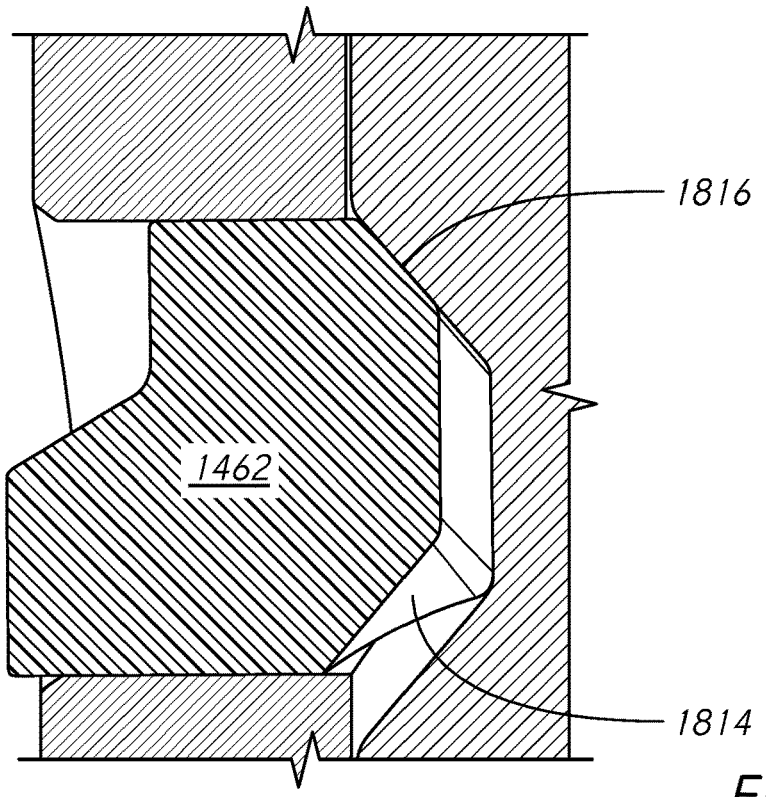
FIG. 12 is a cross-section showing the example locking pin of FIGS. 8.1 to 8.9 disposed in a locking pin receptacle and having asymmetric features to ensure proper installation and alignment.

Referring additionally to FIG. 12, according to further aspects of the disclosure, locking pins may be provided with an asymmetrical configuration of the conical surfaces in order to prevent assembly errors. As can be seen in FIGS. 8.1-8.9 and FIG. 10, the conical surfaces 814, 1814 and 816, 1816 are not symmetrical. In the illustrated example, the conical surface 1814 on the normally upward facing portion of the concave end surface is formed at a deeper depth as compared to the conical surface 1816 on the normally downward facing portion of the concave end surface. At the same time, the conical, chamfered transitions of the actuation pin may be similarly asymmetrical formed to complementarily engage the asymmetrical conical surfaces of the concave end surface. As a result, if the lock pin is inserted upside down, as illustrated in FIG. 12, engagement of the conical surface on the normally downward facing portion of the concave end surface with the conical chamfer of the actuation pin will cause the actuation pin to extend from the transverse bore, thereby causing the locking pin to extend from the piston even in an innermost position of the locking pin against the actuating pin, thereby preventing insertion of the bridge piston into the bore formed in the bridge body.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. In an internal combustion engine comprising a valve train for actuating one or more engine valves, a device for controlling motion applied to the one or more engine valves, comprising:

a housing disposed within the valve train, the housing including a housing bore and at least one housing locking surface;

a piston disposed within the housing bore, the piston having a piston bore and at least one locking pin receptacle defined therein, the at least one locking pin receptacle having a cylindrical shape;

a locking assembly for selectively locking the piston to the housing, the locking assembly comprising an actuator pin supported for movement within the piston bore and at least one respective locking pin disposed in the at least one locking pin receptacle, the at least one locking pin having a cylindrical surface for supporting the at least one locking pin in a respective one of the at least one locking pin receptacle, the actuator pin including an outer locking pin engagement surface adapted to support the at least one locking pin in an extended position, and an inner locking pin support surface adapted to support the at least one locking pin in a retracted position, whereby movement of the actuator pin causes the at least one locking pin to selectively engage or disengage the housing locking surface thereby selectively locking or unlocking the piston relative to the housing, wherein the at least one locking pin includes a locking pin alignment surface adapted to maintain the locking pin in an aligned orientation relative to the actuator pin as the locking pin moves to the retracted position.

2. The device of claim 1, wherein the actuator pin includes a transition surface extending from the outer locking pin engagement surface to the inner locking pin engagement surface and wherein the locking pin alignment surface comprises a chamfer on the locking pin adapted to engage the transition surface and maintain alignment of the locking pin with the actuator pin.

3. The device of claim 2, wherein the transition surface is conical and wherein the locking pin alignment surface comprises a conical chamfer.

4. The device of claim 1, wherein the at least one locking pin includes at least two locking pin alignment surfaces adapted to maintain the locking pin in an aligned orientation relative to the actuator pin as the locking pin moves to the retracted position.

5. The device of claim 4, wherein the actuator pin includes first and second transition surfaces extending from the outer locking pin engagement surface to the inner locking pin engagement surface and wherein the at least two locking pin alignment surfaces comprise a first and second chamfer on the locking pin adapted to engage the first and second transition surfaces and maintain alignment of the locking pin with the actuator pin.

6. The device of claim 1, wherein the housing locking surface is defined in an annular recess in the housing bore.

7. The device of claim 1, wherein the housing locking surface is an inclined surface relative to an axis of the housing bore and wherein the at least one locking pin includes a housing engagement surface that is shaped complementarily to the housing locking surface.

8. The device of claim 1, wherein the housing locking surface has the shape of a conical frustum and wherein the at least one locking pin includes a housing engagement surface that is shaped complementarily to the housing locking surface.

9. The device of claim 1, wherein the housing is a valve bridge.

10. The device of claim 1, wherein the at least one locking pin includes at least two asymmetrical actuator pin engagement surfaces for engaging the actuator pin such that only a single orientation of the locking pin in the locking pin receptacle allows the locking pin to be fully retracted into the piston.

11. The device of claim 10, wherein the at least one locking pin includes asymmetrical conical actuator pin engagement surfaces.

12. The device of claim 1 wherein the locking pin includes a conical surface for engaging the housing surface and a guiding surface extending above the conical surface for guiding the at least one locking pin within the locking pin receptacle.

13. The device of claim 1, wherein the at least one locking pin includes a pair of conical surfaces for engaging the actuator pin.

14. The device of claim 1, wherein the at least one locking pin receptacle is dimensioned to accommodate tilting of the locking pin within the locking pin receptacle.

15. The device of claim 1, wherein the at least one locking pin receptacle comprises two axially aligned locking pin receptacles.

* * * * *